US005351386A

United States Patent [19]

Chang

[11] Patent Number: 5,351,386

[45] Date of Patent: Oct. 4, 1994

[54] BUNDLING STRAP DISPENSER

[76] Inventor: Kun-sheng Chang, No. 25, Lane 59, Chung Cheng Rd., Lu Chou Hsiang, Taipei Hsien, Taiwan

[21] Appl. No.: 106,268

[22] Filed: Aug. 13, 1993

[51] Int. Cl.[5] ..... B25B 25/00

[52] U.S. Cl. ..... 29/566.1; 29/267; 140/93.2

[58] Field of Search ..... 29/33.5, 566.1, 566.4, 29/267; 140/93 A, 93.2, 93.4, 123.6

[56] References Cited

U.S. PATENT DOCUMENTS

| | | | |
|---|---|---|---|
| 3,670,782 | 6/1972 | Kabel | 140/93.2 |
| 3,695,308 | 10/1972 | Kabel | 29/566.1 X |
| 4,498,507 | 2/1985 | Thompson | 140/93.2 |
| 4,610,067 | 9/1986 | Hara | 29/33.5 |
| 4,763,700 | 8/1988 | Hidaka et al. | 140/93.2 |
| 4,908,911 | 3/1990 | Bretti et al. | 140/93 A |
| 5,088,395 | 2/1992 | Schottke | 140/123.6 X |
| 5,230,129 | 7/1993 | Scruggs | 29/267 |

FOREIGN PATENT DOCUMENTS

| | | | |
|---|---|---|---|
| 887996 | 12/1971 | Canada | 140/93.2 |

*Primary Examiner*—William Briggs
*Attorney, Agent, or Firm*—Poms, Smith, Lande & Rose

[57] ABSTRACT

A bundling strap dispenser includes a housing, a trigger pivotally mounted in the housing and is manually operable from outside, a cutting blade pivotally mounted in the housing and actuatable by the trigger, a retaining member mounted to the cutting blade to pivot therewith for retaining a bundling strap when the bundling strap is being cut, a rib extending horizontally in the upper section of the housing and having an opening through which the retaining element is passable, and a stepped plate mounted above the rib to define a passage therebetween for the bundling strap. The stepped plate further includes a trough for receiving a buckle member therein for engaging with the bundling strap. The trough has a slot in alignment with the opening of the buckle member reloader and a second slot in a bottom side thereof through which the cutting blade is passable to cut the bundling strap after the bundling strap is retained. A feeding device is mounted above the rib for feeding a new buckle member after a previous buckle is used and removed.

6 Claims, 7 Drawing Sheets

BUNDLING STRAP DISPENSER

BACKGROUND OF THE INVENTION

1. Field of the Invention

The present invention relates to a dispenser for bundling strap.

2. Description of Related Art

Straps are usually utilized to bundle articles, in which two ends of a strap are generally securely held in a buckle member. Currently available straps are in a certain length and this often results in a waste of the straps when being used to bundle small articles. In addition, as the buckle member is integral with the strap, there is also a waste of the former as the former is also abandoned when the latter is destroyed for accessing the bundled articles.

The present invention provides a bundling strap dispenser to mitigate and/or obviate the above-mentioned problems.

SUMMARY OF THE INVENTION

The present invention provides a bundling strap dispenser, comprising a housing, a trigger means which is pivotally mounted in the housing and is manually operable from outside, a substantially U-shaped linking plate pivoted and actuatable by the trigger means and a second end, and a cutting means having a cutting blade attached to a first end thereof and a second end pivotally mounted above the linking plate and thus actuatable by the linking plate when depressing the trigger means.

The dispenser further has a buckle member reloader securely attached to the cutting means, including an opening through which a bundling strap passes and a pair of reloading lugs. A resilient member mounted to the pivoted end of the cutting means to pivot therewith includes a retaining element with a toothed end for retaining the bundling strap when cutting the bundling strap and a returning member for returning the resilient member, the cutting blade, and the linking plate back to their original positions before re-triggering. A rib extends horizontally in the upper section of the housing and has a second opening through which the toothed end of the retaining element is passable. A stepped plate is mounted above the rib and defines a passage therebetween for the bundling strap. The stepped plate further includes a buckle-receiving trough with a slot to communicate the passage with the opening of the buckle member reloader and a second slot in a bottom side thereof through which the cutting blade is passable to cut the bundling strap after an article is firmly bundled.

A rod is mounted above the rib and carries a plurality of buckle members along a longitudinal axis thereof. The rod is attached to a block with a third opening in alignment with the passage for the bundling strap. A spring is mounted around the rod and an urging block is attached to an end of the spring for feeding the buckle members.

By such an arrangement, an actuation of the trigger means urges the toothed end of the retaining member to pass through the opening in the rib to retain the bundling strap, and a further actuation of the trigger means urges the cutting blade to cut the bundling strap. The lugs carry a new buckle member fed by the urging block after an old buckle member is used and removed.

Other objects, advantages, and novel features of the invention will become more apparent from the following detailed description when taken in conjunction with the accompanying drawings.

DESCRIPTION OF THE PREFERRED EMBODIMENT

Figure 1:
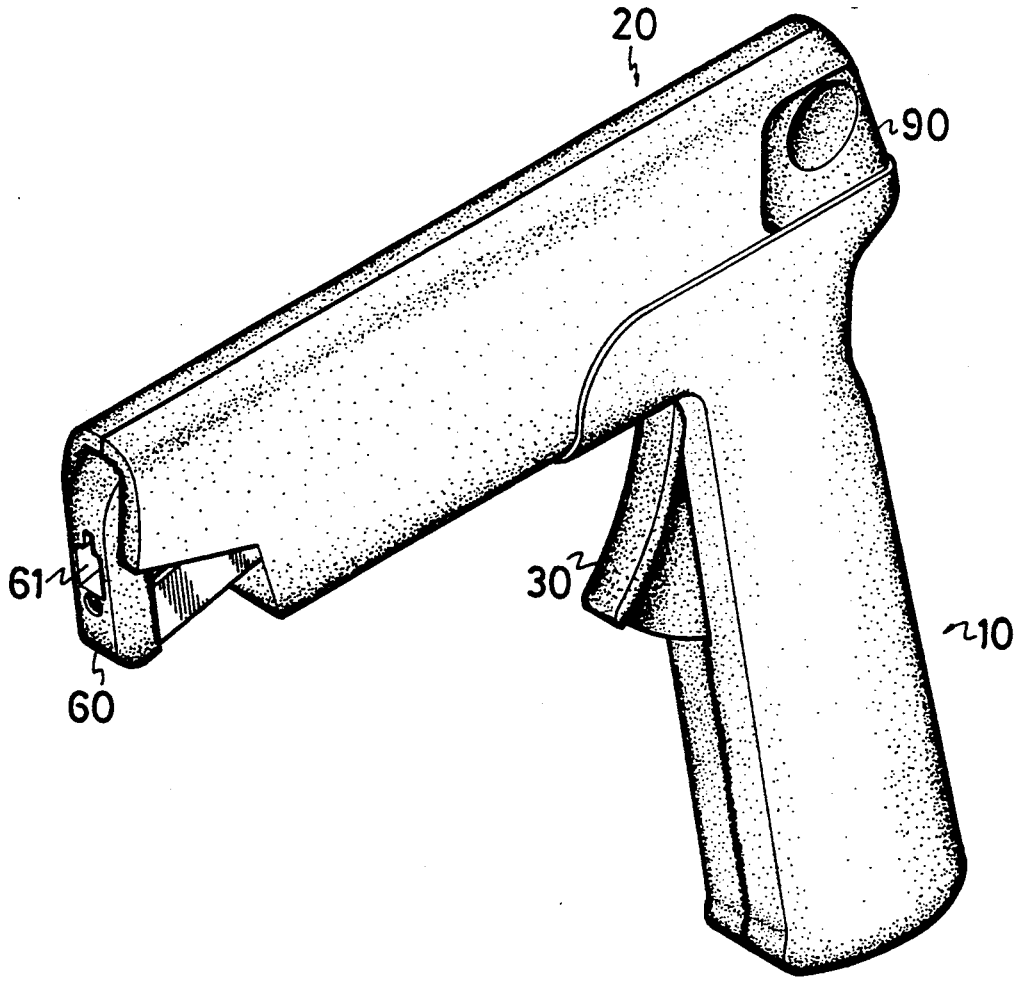
FIG. 1 is a perspective view of a bundling strap dispenser in accordance with the present invention.
Figure 2:
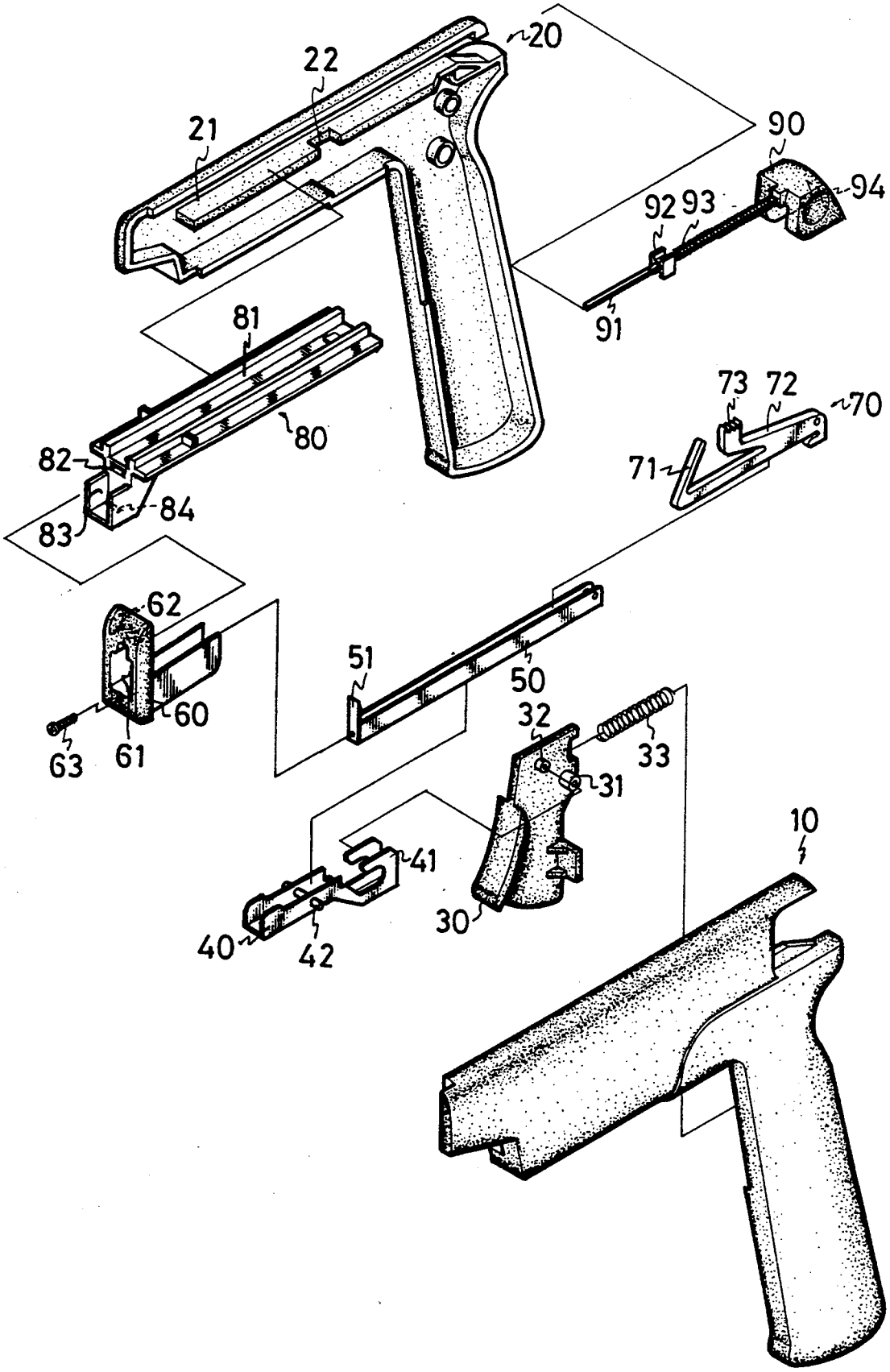
FIG. 2 is an exploded view of the bundling strap dispenser.
Figure 3:
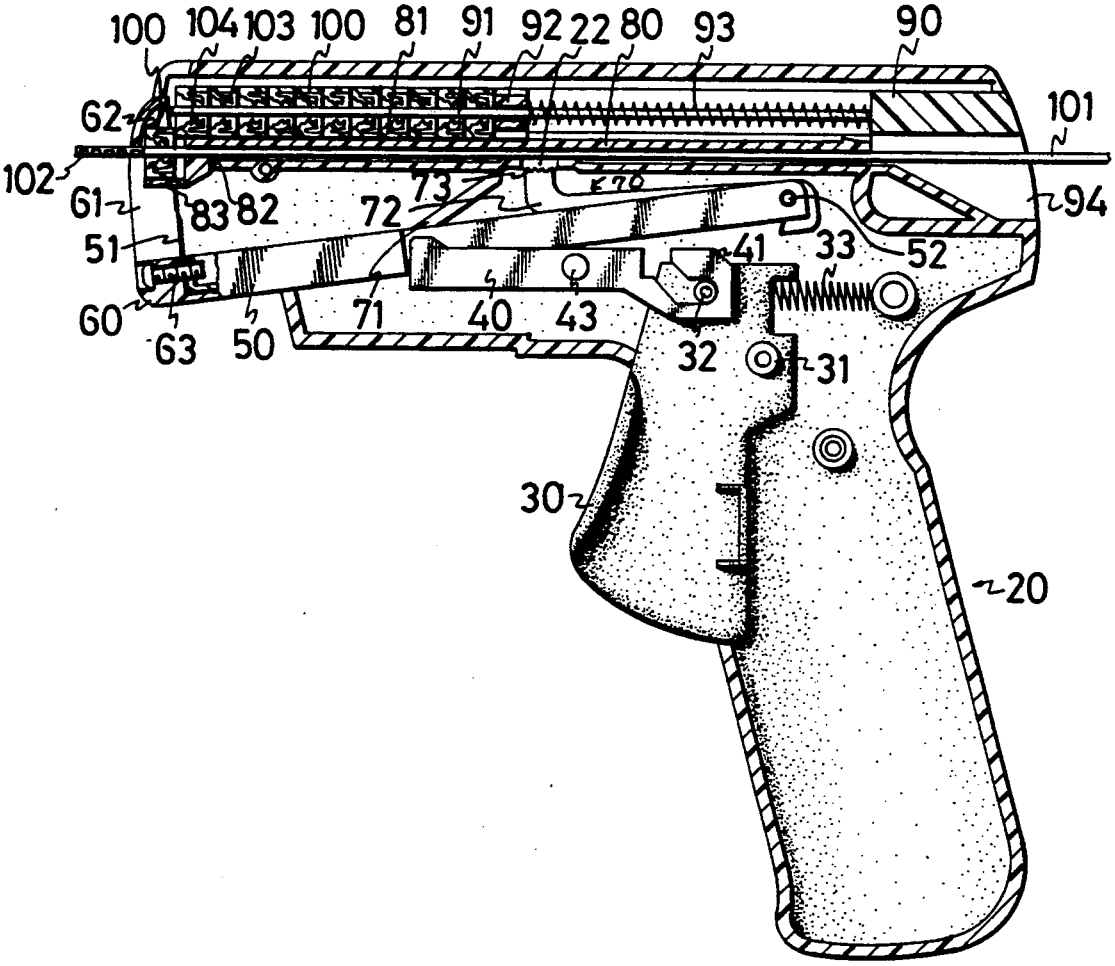
FIGS. 3 through 7 are cross-sectional views illustrating the operation of the dispenser.

Referring to the drawings and initially to FIGS. 1 through 3, a bundling strap dispenser in accordance with the present invention generally has a contour of a gun and includes a housing comprised of first and second half housing sections 10 and 20. A trigger means 30 is pivotally mounted about a pin 31 in the housing and is manually operable from outside. A spring 33 is provided to return the trigger means 30 after it is released. A substantially U-shaped linking plate 40 is pivoted at a mediate section thereof (see pin 42) to the housing, with a substantially hooked first end 41 thereof engaging with a peg 32 on the trigger means 30 and thus being actuatable by the trigger means 30 to pivot about the pin 42.

A cutting means 50, substantially U-shaped in section and having a cutting blade 51 at a first end thereof, is mounted above the linking plate 40 and is pivotable about pin 52 (see FIG. 3) at a second end thereof. A substantially L-shaped buckle member reloader 60 is attached to the first end of the blade means 50 by a screw 63 and includes an opening 61 through which the bundling strap 101 passes and a pair of reloading lugs 62 for carrying a new buckle member 100 after the removal of a previous one, which will be discussed in detail later. A resilient member 70 is mounted to pin 52 of the U-shaped cutting means 50 to pivot therewith and includes a retaining element 72 with a toothed end 73 for retaining the bundling strap 101 when cutting the bundling strap 101 by means of the cutting blade 51. The resilient member 70 further includes a returning member 71 for returning itself as well as the cutting blade 51 and the linking plate 40 back to their original positions before re-triggering.

A rib 21 extends horizontally in the upper section of the housing section 20 and has an opening 22 through which the toothed end 73 of the retaining element 72 is passable. A stepped plate means 80 is mounted above the rib 21 and also extends horizontally. The stepped plate means 80, together with the rib 21, defines a passage for the bundling strap 101. The stepped plate means includes two ribs formed thereon so that a slot 81 is defined between the ribs of the stepped plate means. Several buckle members 100 can be received in the slot 81. The stepped plate means 80 further includes a trough 83 with a slot 82 to communicate the passage with the opening 61 of the buckle member reloader 60 and a second slot 84 in a bottom side thereof through which the cutting blade 51 is passable to cut the bundling strap 101 after the article is firmly bundled.

Several buckle members 100 may be strung along a rod 91 which is attached to a block 90 with an opening 94 in alignment with the passage for the bundling strap 101. A spring 93 is mounted around the rod 91 and an urging block 92 is attached to an end of the spring 93 for feeding the buckle members 100. As shown in FIG. 3, the buckle members 100 are strung on the rod 91 and each has upper and lower single direction teeth structures 103 and 104 and sufficient clearance to receive and securely "catch" the bundling strap 101. The bundling strap 101 has a plurality of corresponding recesses 102 (see FIG. 3) in one side thereof to receive the single direction teeth structures 103, 104.

Figure 4:
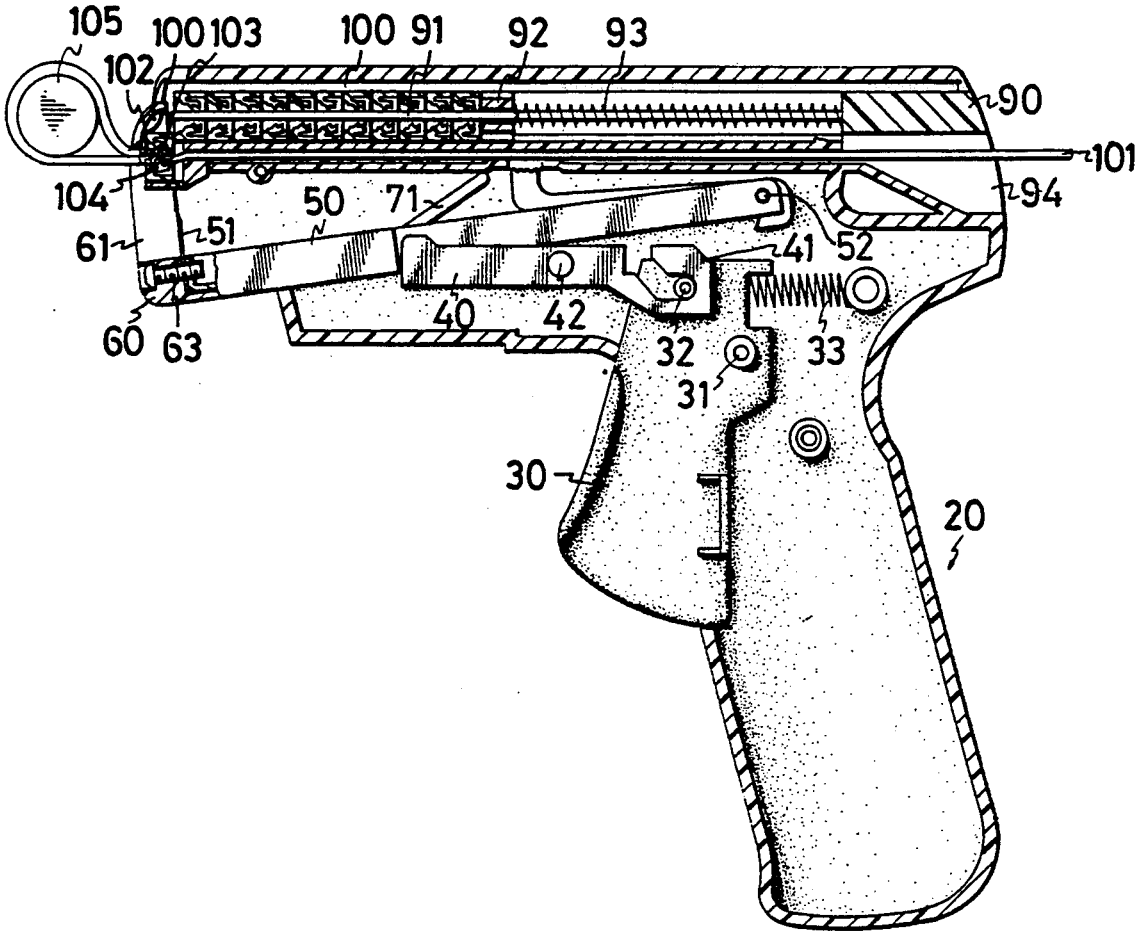
Figure 5:
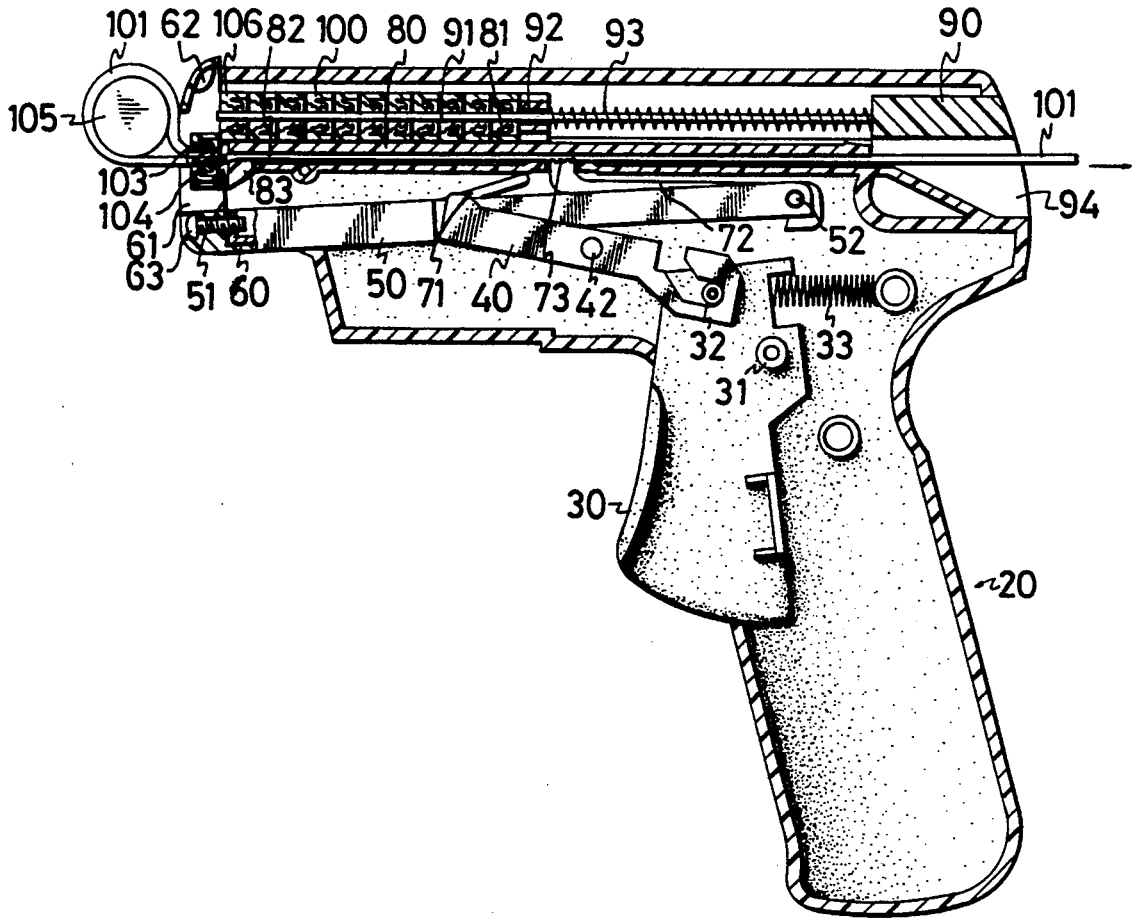
Figure 6:
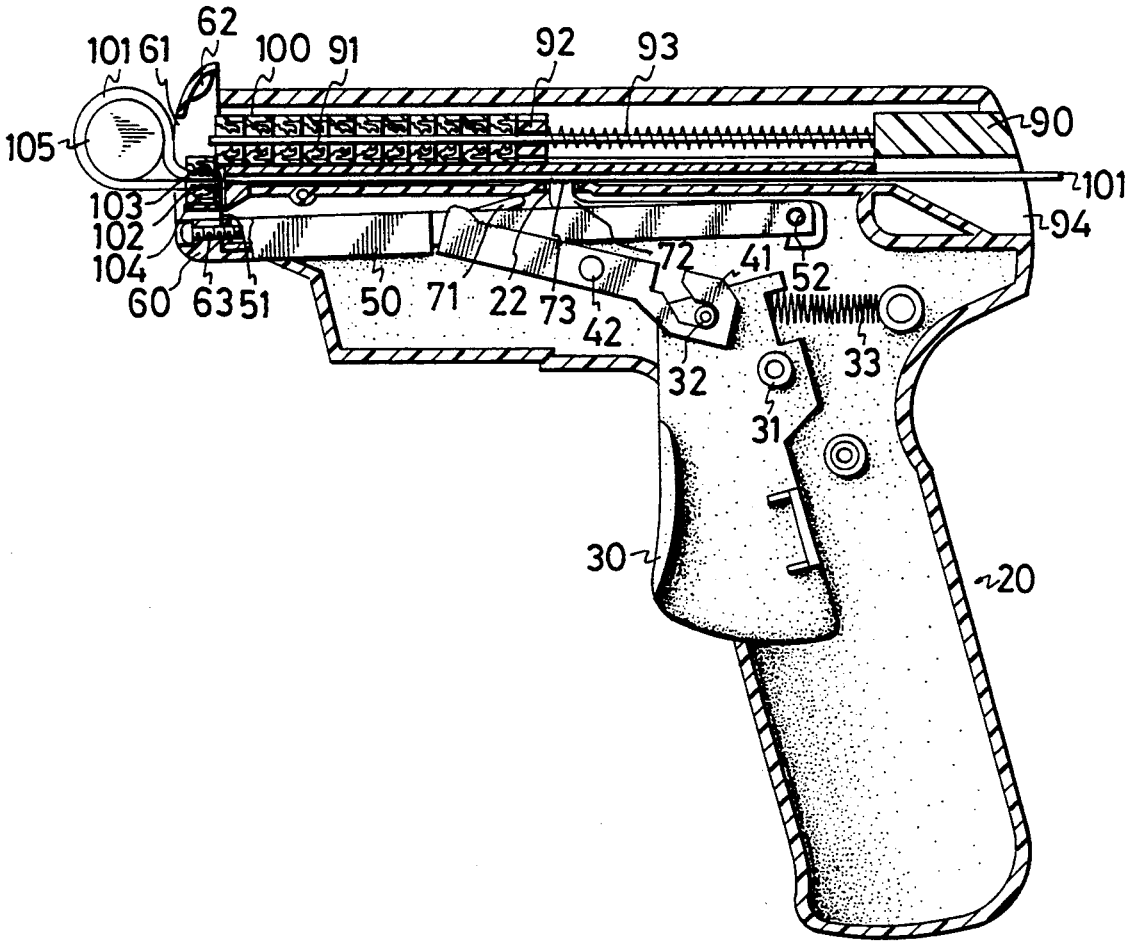
Figure 7:
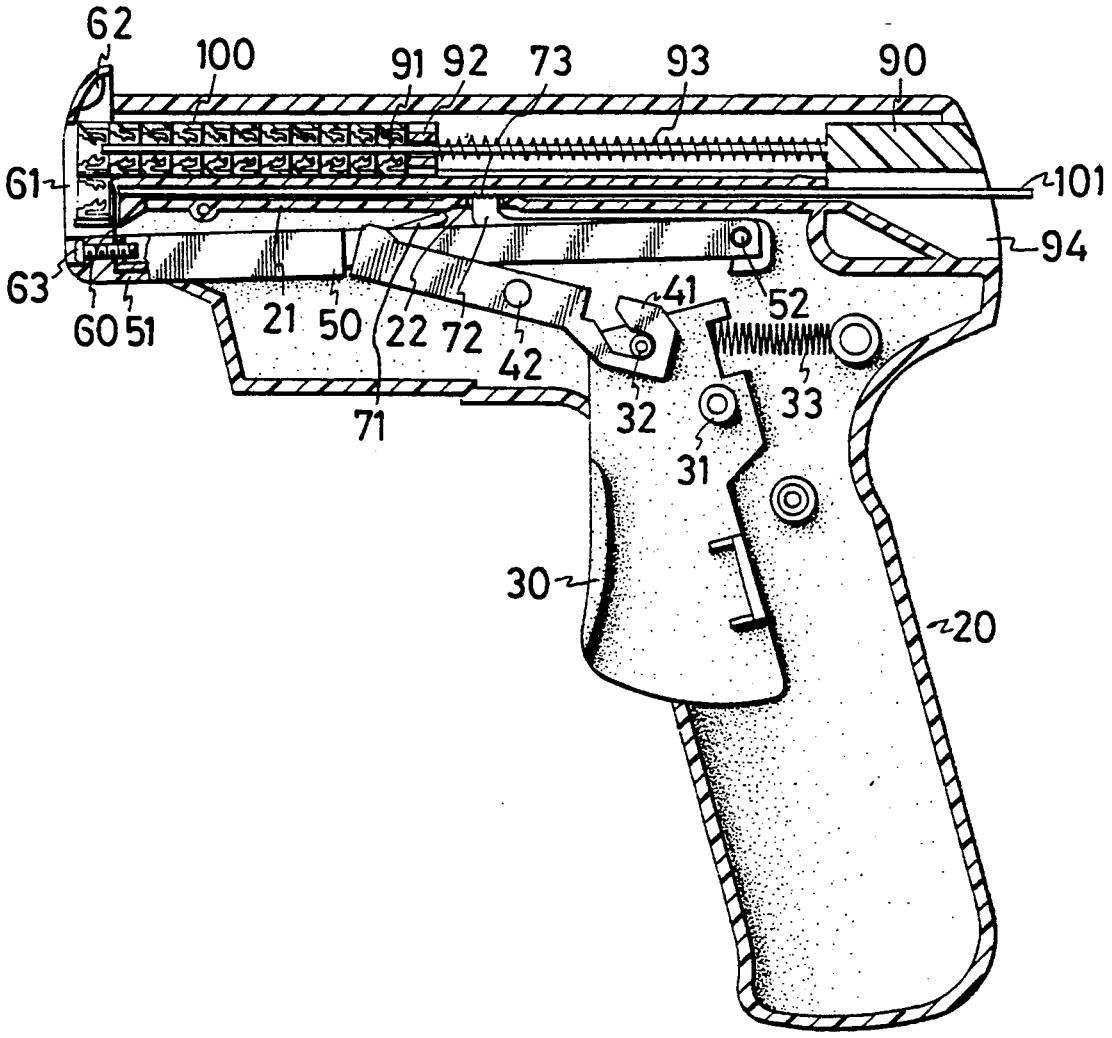

Referring now to FIGS. 3 through 7, when bundling is required, the bundling strap 101 is passed from the opening 94 in the block 90 at the rear end of the gun-shaped dispenser, through the passage defined by the rib 21 and the stepped plate means 80 and further through slot 82 in the stepped plate means 80 and the opening 61 in the buckle member reloader 60, as shown in FIG. 3. The lower single direction teeth structure 104 allows the strap 101 to slide leftward yet forbids the strap 101 to slide rightward. The user then, after surrounding the article 105 to be bundled by the front free end of the bundling strap 101, inserts the front free end of the bundling strap 101 into the opening 61 to securely engage with the upper single direction teeth structure 103, as shown in FIG. 4. The upper single direction teeth structure 103 allows the strap 101 to slide rightward yet forbids the strap 101 to slide leftward, thus preventing the bundling strap 101 from being loosened. Thereafter, as indicated by the arrow in FIG. 5, the user pulls the strap 101 rearward (i.e., rightward as seen from FIG. 5) to ensure that the article is firmly bundled. The user then depresses the trigger means 30, thereafter, due to the pivotal movement of the linking member 40 about pin 42 responsive to the pivotal movement of the trigger means 30 about pin 31, the retaining means 70 pivots upward about pin 52 such that the toothed end 73 thereof passes through the opening 22 in the rib 21 to retain the bundling strap 101, while the cutting blade 51 also moves upward to pass through slot 84 in the trough 83 of the stepped plate means 80 and thus approaches the bundling strap 101. After that, the user further triggers the trigger means 30 to cause further upward movement of the cutting blade 51 to cut the bundling strap 101, as shown in FIG. 6. After the cutting, the bundled article 105 as well as the buckle member 100 fall due to the weight of the bundled article 105, i.e., the buckle member 100 is removed from the dispenser. At this moment, the lugs 62 are above the passage for reloading of the buckle heads 100, a new buckle member 100 is urged leftward by the spring force of spring 93 to a place below the lugs 62 (see FIG. 7). Then, the user may release the trigger means 30, the lugs 62 of the reloader 60 carry the new buckle member 100 downward into the trough 83 in the stepped plate 80. All elements are returned to their original positions by spring 33 and element 71. For subsequent operation, the user may urge the remaining bundling strap 100 leftward to engage with the lower teeth structure of the new buckle member 100, the above-mentioned procedure is repeated.

According to the above description, the present invention has the following advantages:

(1) the bundling strap 101 can be manufactured to be relatively long and can be economically used for bundling;

(2) the buckle members 100, when used with the present dispenser, may be repeatedly used; and (3) the time for bundling articles can be reduced.

Although the invention has been explained in relation to its preferred embodiment, it is to be understood that many other possible modifications and variations can be made without departing from the spirit and scope of the invention as hereinafter claimed.

I claim:

1. A bundling strap dispenser comprising:

a housing;

a trigger means pivotally mounted in the housing and manually operable from outside;

a cutting means having a cutting blade and being pivoted in the housing and actuatable by the trigger means;

a retaining member mounted to the cutting means to pivot therewith for retaining a bundling strap when cutting the bundling strap;

a rib extending in the upper section of the housing and having an opening through which the retaining member is passable;

a stepped plate means mounted above the rib and defining a passage therebetween for the bundling strap, the stepped plate means further including a trough in which a buckle for engaging with the bundling strap is received; the trough having a slot in alignment with the passage and a second slot in a bottom side thereof through which the cutting blade is passable to cut the bundling strap after the bundling strap is retained; and a feeding means mounted above the rib for feeding a new buckle member after the buckle member in the trough is used and removed.

2. The bundling strap dispenser as claimed in claim 1 further comprising a means for returning the trigger means when the trigger means is released.

3. The bundling strap dispenser as claimed in claim 1 wherein the buckling member has upper and lower single direction teeth structures and the bundling strap has a plurality of recesses in one side thereof to receive the single direction teeth structures.

4. The bundling strap dispenser as claimed in claim 1 wherein the feeding means includes:

a rod adapted to carry a plurality of buckle members along a longitudinal axis thereof, the rod being attached to a block with a third opening in alignment with the passage for the bundling strap, a spring being mounted around the rod and an urging block being attached to an end of the spring for feeding the buckle members; and a buckle member reloader securely attached to the first end of the blade means, including an opening through which the bundling strap passes and a reloading element for carrying the new buckle into the trough of the stepped plate means.

5. The bundling strap dispenser as claimed in claim 1 wherein the retaining member has a toothed end which passes through the opening in the rib upon actuation of the trigger means to retain the bundling strap when cutting the bundling strap.

6. The bundling strap dispenser as claimed in claim 1 wherein a linking plate is pivoted to the housing and is actuatable by the trigger means, and the cutting means is pivotally mounted above the linking plate and is actuatable by the linking plate upon a triggering of the trigger means.

* * * * *

US005351386C1

(12) REEXAMINATION CERTIFICATE (4396th)

United States Patent

Chang

(10) Number: US 5,351,386 C1

(45) Certificate Issued: Jul. 10, 2001

(54) BUNDLING STRAP DISPENSER

(75) Inventor: Kun-sheng Chang, No. 25, Lane 59, Chung Cheng Rd., Lu Chou Hsiang, Taipei Hsien (TW)

(73) Assignee: Kun-sheng Chang, Taipei Hsien (TW)

Reexamination Request:
No. 90/005,612, Jan. 18, 2000

Reexamination Certificate for:

| | |
|---|---|
| Patent No.: | **5,351,386** |
| Issued: | **Oct. 4, 1994** |
| Appl. No.: | **08/106,268** |
| Filed: | **Aug. 13, 1993** |

(51) Int. Cl.[7] ..... B25B 25/00

(52) U.S. Cl. ..... 29/566.1; 29/267; 140/93.2

(58) Field of Search ..... 29/33.5, 267, 566.1, 29/566.4; 140/93 A, 93.2, 93.4, 123.6

(56) References Cited

U.S. PATENT DOCUMENTS 3,670,782 6/1972 Kabel .
3,695,308 10/1972 Kabel .
4,763,700 8/1988 Hidaka et al. .

FOREIGN PATENT DOCUMENTS 4-3939Y2 2/1992 (JP) .

*Primary Examiner*—William Briggs

(57) ABSTRACT

A bundling strap dispenser includes a housing, a trigger pivotally mounted in the housing and is manually operable from outside, a cutting blade pivotally mounted in the housing and actuatable by the trigger, a retaining member mounted to the cutting blade to pivot therewith for retaining a bundling strap when the bundling strap is being cut, a rib extending horizontally in the upper section of the housing and having an opening through which the retaining element is passable, and a stepped plate mounted above the rib to define a passage therebetween for the bundling strap. The stepped plate further includes a trough for receiving a buckle member therein for engaging with the bundling strap. The trough has a slot in alignment with the opening of the buckle member reloader and a second slot in a bottom side thereof through which the cutting blade is passable to cut the bundling strap after the bundling strap is retained. A feeding device is mounted above the rib for feeding a new buckle member after a previous buckle is used and removed.

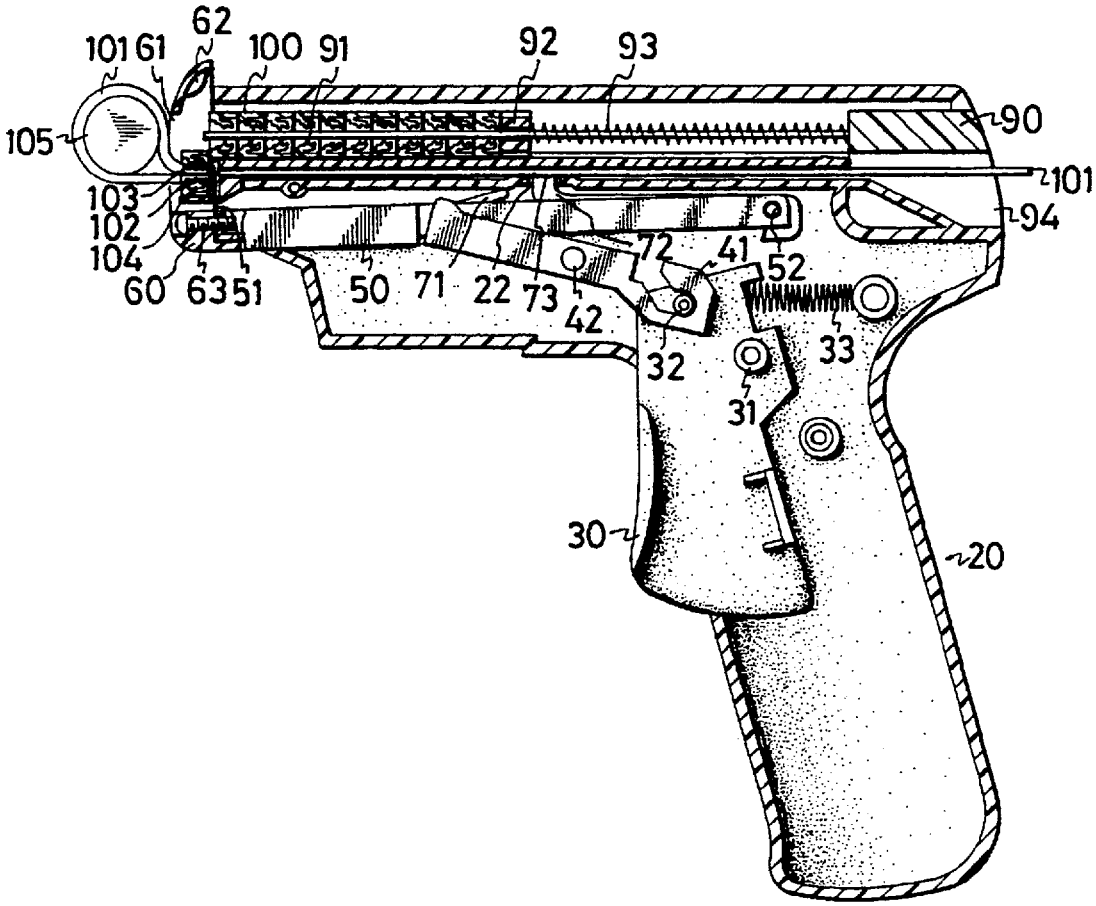

REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1–6 are cancelled.

* * * * *